US005970773A

United States Patent [19]

Engel et al.

[11] Patent Number: 5,970,773

[45] Date of Patent: Oct. 26, 1999

[54] ROLLING PLANT FOR ROLLING ALL TYPES OF FINISHED SECTIONS

[75] Inventors: Georg Engel, Düsseldorf; Ulrich Svejkovsky, Wuppertal; Hans-Jürgen Nowak, Kamp-Lintfort, all of Germany

[73] Assignee: SMS Schloeman-Siemag Aktiengesellschaft, Düsseldorf, Germany

[21] Appl. No.: 09/177,297

[22] Filed: Oct. 22, 1998

[30] Foreign Application Priority Data

Oct. 29, 1997 [DE] Germany ..... 197 47 656

[51] Int. Cl.[6] ..... B21B 39/20

[52] U.S. Cl. ..... 72/251; 72/225; 72/226; 72/336.2

[58] Field of Search ..... 72/225, 226, 227, 72/234, 251, 336.2; 29/527.7

[56] References Cited

U.S. PATENT DOCUMENTS

| | | | |
|---|---|---|---|
| 4,791,799 | 12/1988 | Engel et al. | 72/225 |
| 5,020,354 | 6/1991 | Kosak et al. | 72/225 |
| 5,287,714 | 2/1994 | Kusaba | 72/225 |
| 5,343,726 | 9/1994 | Reth | 72/225 |
| 5,664,452 | 9/1997 | Engel et al. | 72/225 |
| 5,904,061 | 5/1999 | Engel et al. | 72/225 |

*Primary Examiner*—Lowell A. Larson
*Assistant Examiner*—Ed Tolan
*Attorney, Agent, or Firm*—Friedrich Kueffner

[57] ABSTRACT

A rolling plant for rolling all types of finished sections from flat blooms or preliminary sections with close to final dimensions, wherein the blooms or preliminary sections arrive from a continuous casting plant and may be stored in reheating furnaces arranged in front of the plant and/or may be maintained at rolling temperature. The rolling plant includes a compact rolling group with two universal stands arranged closely one behind the other and an edging stand arranged between the universal stands. A roughing group is arranged in front of and parallel offset to the compact rolling group, wherein the roughing group is composed of a group of a vertical stand, a horizontal stand and a universal stand arranged closely one behind the other. A roller table each is arranged in front of and following the compact rolling group, wherein the length of each roller table corresponds to the exit length of the finish-rolled stock; arranged following the roughing group is another roller table which extends parallel to the two roller tables over the length of both of these roller tables and past the compact rolling group, wherein transverse conveying units are arranged between the parallel roller tables.

19 Claims, 7 Drawing Sheets

VP

1
VG
2
HG
3
UG
VW
4
VW
UG1
5
HZ
6
UG2
ZW
ZW
VW
VW
R9
R8
ZW
R7
ZW
VW
10
VW
11
12
ZW
ZW

VP
1
VG
K1
10
6
2
K2
14
HG
R9
R5
R13
11
7
3
UG
R8
R12
R4
15
UG1
16
HZ
17
UG2

ROLLING PLANT FOR ROLLING ALL TYPES OF FINISHED SECTIONS

BACKGROUND OF THE INVENTION

1. Field of the Invention

The present invention relates to a rolling plant for rolling all types of finished sections from flat blooms or preliminary sections with close to final dimensions, wherein the blooms or preliminary sections arrive from a continuous casting plant and may be stored in reheating furnaces arranged in front of the plant and/or may be maintained at rolling temperature. The rolling plant includes a compact rolling group with two universal stands arranged closely one behind the other and an edging stand arranged between the universal stands, wherein a roughing group is arranged in front of and parallel offset to the compact rolling group and wherein the roughing group is composed of a group of a vertical stand, a horizontal stand and a universal stand arranged closely one behind the other.

2. Description of the Related Art

Conventional rolling plants of the above-described type are, with respect to their configuration and their roll stands and additional equipment used, only suitable for rolling certain types of rolled products, for example, for heavy sections and/or heavy girders or for light and medium girders and possibly for corresponding sections. Depending on the market which can be reached, the operation of such rolling plants frequently poses difficulties with respect to the rate of utilization and, thus, the possibility of economically operating such plants.

SUMMARY OF THE INVENTION

Therefore, it is the primary object of the present invention to improve the rolling plant of the above-described type in such a way that it is capable of manufacturing all types of the usual commercial sections including standard sections as well as, to a limited extent, special sections, for example light and heavy girders, sheet pile sections or lift mast sections; it should be possible to manufacture all these sections also in small lot sizes.

In accordance with the present invention, a roller table each is arranged in front of and following the compact rolling group, wherein the length of each roller table corresponds to the exit length of the finish-rolled stock; arranged following the roughing group is another roller table which extends parallel to the two roller tables over the length of both of these roller tables and past the compact rolling group, wherein transverse conveying units are arranged between the parallel roller tables.

In accordance with another feature of the invention, the roughing group is composed of a two-high vertical stand, a two-high horizontal stand and a universal stand. The horizontal stand of the roughing group and possibly the horizontal stand of the compact rolling group may be equipped with two or more selectable grooves. For roughing-rolling and finish-rolling of H-sections, the set of rolls of universal stands of the roughing group is equipped with a H-type groove configuration with cylindrical vertical rolls. For rolling thin-walled girders, it is possible to use an X-type groove configuration with V-shaped vertical rolls, and for rolling special sections, it is possible to use an appropriate groove configuration of the horizontal and vertical rolls.

For rolling certain sections, the universal stands of the compact rolling group may also be equipped with two-high roll sets. The horizontal rolls of the universal stand of the roughing group advantageously may have a diameter in the range 1,200 and 1,800 mm and the horizontal rolls of the universal stands of the compact rolling group may have diameters in the range of 800 to 1,300 mm.

In accordance with the present invention, the above-described rolling plant can be operated in such a way that heavy finished sections, particularly H-sections, are finish-shaped in the roughing group, are conveyed over the roller table extending past the compact rolling group and moved onto the roller table arranged following the compact rolling group by means of the transverse conveying unit arranged between the roller table extending past the compact rolling group and the roller table following the compact rolling group, and is conveyed to subsequent further processing units.

The universal stand at the exit side of the compact rolling group can also be reached by using the roller table extending past the compact rolling group and by moving the rolling stock onto the roller table arranged following the compact rolling group by means of the transverse conveying unit arranged between the roller table following the compact rolling group and the roller table extending past the compact rolling group.

When the roughing group is equipped with a two-high roughing stand with smooth rolls, a two-high horizontal stand with profiled rolls and a universal stand, a preliminary section having a rectangular cross-section or I-shaped cross-section is edged in the two-high roughing stand, is subsequently preshaped in the two-high horizontal stand and the section is subsequently shaped and possibly reduced in the universal stand of the roughing group, and the section is finish-shaped subsequently in the compact rolling group in continuous pass sequences and possibly reversing pass sequences through the universal stand and the horizontal stand of this group.

Edging-shaping and section-shaping of the preliminary section in the roughing group can be effected in a continuous pass sequence through the stands of this group or section-shaping and section-reducing of the preliminary section can be effected in this group in successive pass and reversing pass sequences through the two-high horizontal stand and the universal stand.

When the stands of the compact rolling group are equipped with pairs of grooved horizontal rolls, finish-shaping of a thin-wall section from a preliminary section with I-shaped cross-section can be effected in the compact rolling group in a continuous pass sequence through the stands of this group.

When the horizontal stand of the roughing group is equipped with selectable grooves, preferably two selectable grooves, it is possible during the consecutive passes and reversing passes in the roughing group to effect the further production of the section once again in the first selectable groove and in subsequent consecutive passes in the next selectable groove and then again the further production of the section in pass and reversing pass sequences in the universal stand on the entry side and in the edging stand with a concluding pass sequence through the universal stand on the entry side of the compact rolling group, the edging stand and the universal stand on the exit side of the compact rolling group.

When rolling heavy finished sections having H-shaped cross sections, the section can be edged in the vertical stand of the roughing group and the flanges can be edged subsequently in a pass and a reversing pass sequence in the horizontal stand in accordance with conventional rolling technology, and the section can be shaped and reduced in the universal stand and then finish-rolled in this group in a last pass through the universal stand.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
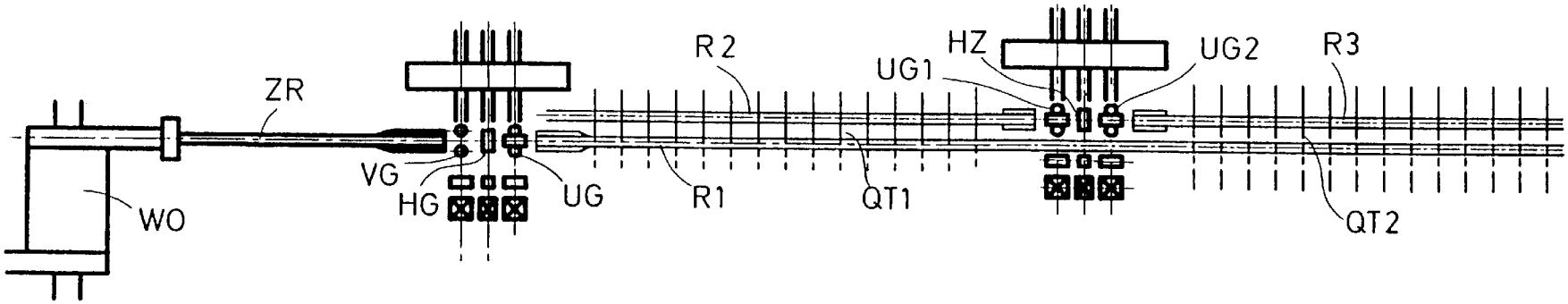
FIG. 1 is a schematic top view of a rolling plant according to the present invention.

As illustrated in FIG. 1, the rolling plant according to the present invention is arranged following a reheating furnace WO, wherein a feeding roller table ZR extends from the reheating furnace WO to a roughing group which is composed of a vertical stand VG, a horizontal stand HG and a universal stand UG. This roughing group is followed by a roller table R1 which extends parallel to another roller table R2 which is arranged in front of a tandem compact rolling group which is composed of two universal stands UG1 and UG2 and a horizontal intermediate stand HZ arranged between the universal stands UG1 and UG2. This tandem compact rolling group is followed by a roller table R3. The roller table R1 extending parallel to the roller table R2 extends past the tandem compact rolling group and then extends parallel to the roller table R3. Transverse conveying units QT1 and QT2 are arranged between the roller table R1 and the roller tables R2 and R3, respectively.

Preliminary sections which are cast in a continuous casting plant, not shown, as preliminary sections with flat cross-section, bloom cross-section or a cross-section which is close to the final dimension, and which may have been heated to or maintained at rolling temperature in the reheating furnace WO and which are descaled in a descaling plant, also not shown, for example, a high-pressure water spraying unit and are then conveyed over the feeding roller ZR to the roughing group, are rolled in the roughing group in which a first adjustment of the cross-section of the preliminary section to the finished section to be rolled takes place. After leaving the roughing group, the preshaped and possibly already shape-reduced sections are subsequently moved by means of the transverse conveying unit QT1 onto the roller table R2 and are fed by the roller table R2 to the tandem compact rolling group in which they are finish-rolled.

Figure 2:
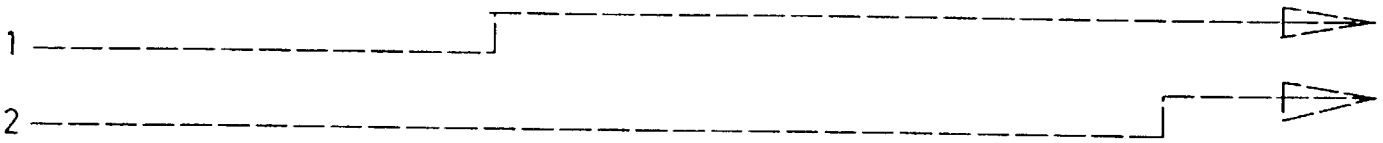
FIG. 2 is a diagram showing the travel of the rolling stock.

This rolling procedure is diagrammatically illustrated in FIG. 2 and identified by reference number 1. Heavy sections, for example, H-shaped sections, can be finish-rolled already in the roughing group and then conveyed over the roller table R2 past the tandem compact rolling group, are then moved by the transverse conveying unit QT2 to the roller table R3 of this rolling group and are supplied from there to further processing units, for example, adjusting units. This rolling procedure is diagrammatically illustrated in FIG. 2 and identified by reference number 2.

The horizontal stand HG of the roughing group may be equipped with a device for groove shifting for several selectable grooves, at least two selectable grooves. The tandem compact rolling group may be equipped with roll sets for X-H-rolling. The two universal stand UG1 and UG2 may optionally also be equipped with two-high roll sets, and the horizontal stand HZ can be equipped with selectable grooves. Together with the transverse conveying unit QT2 and the roller table R3, the arrangement of the roller table R1 extending past the compact rolling group makes it possible to reach the tandem compact rolling group from the exit side thereof so that an even number of passes is possible during the reversing operation, for example, with two passes instead of three, or four passes instead of five, if this is already sufficient for achieving the final shaping of the section.

When rolling, for example, heavy sections, the rolling procedure 1 illustrated in FIG. 2 makes it possible to reassemble or maintain the tandem compact rolling group which is not in use.

Figure 3:
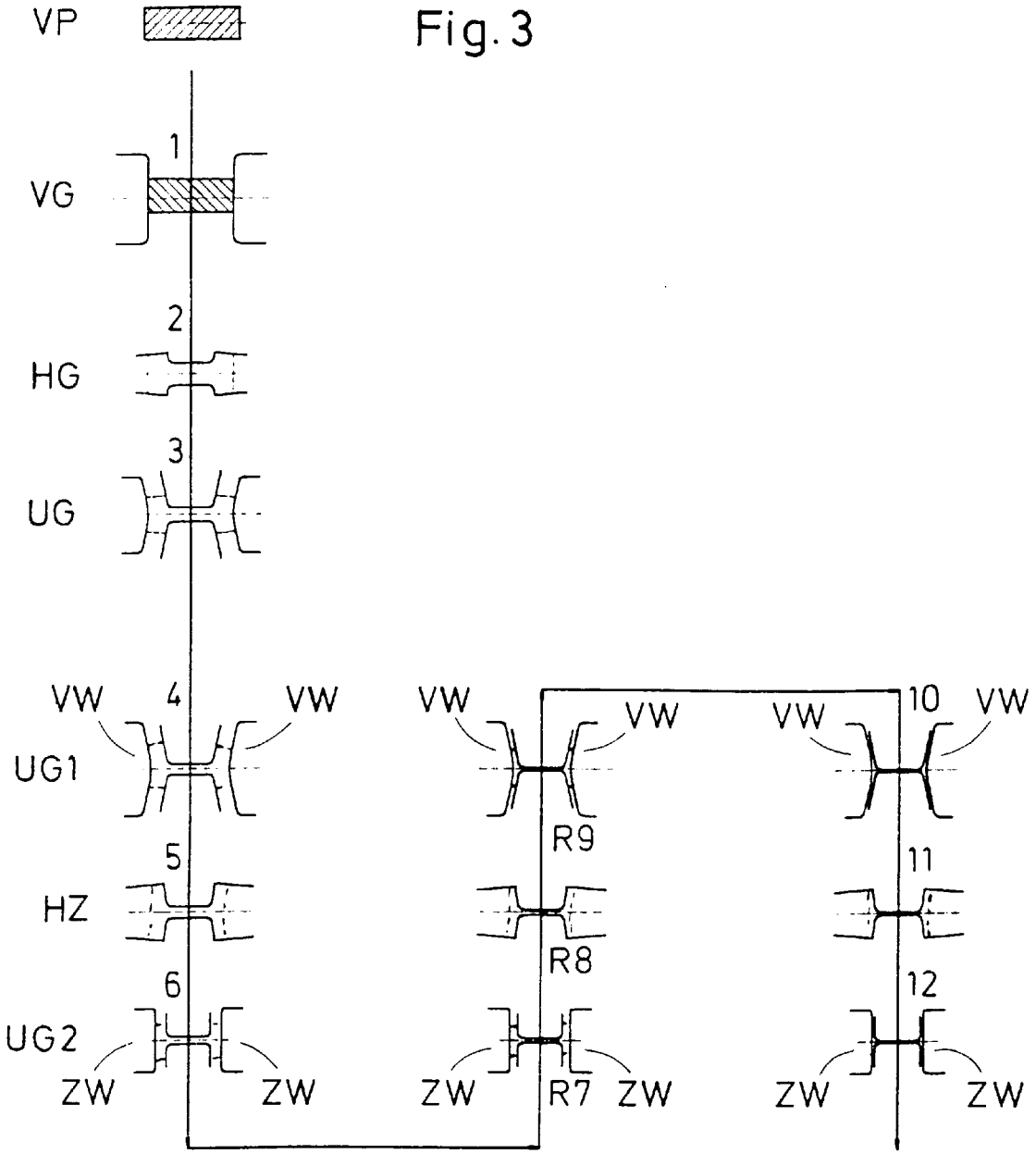
FIGS. 3 to 8 are pass schedules for the roll stand arrangement according to FIG. 1.

When carrying out the pass schedule according to FIG. 3, the roughing group is equipped with a vertical two-high stand VG with smooth rolls, a horizontal two-high stand HG with groove rolls and a universal stand UG. As shown, the preliminary section VP is edged in one pass 1 in the vertical stand VG, is preshaped in another pass 2 in the horizontal stand HG and is already shaped into the section in a third pass 3 in the universal stand UG. Subsequently, finish-shaping with section-shaping and section-reduction is carried out in the tandem compact rolling group in a continuous pass sequence 4, 5, 6 through the universal stand UG1 of the horizontal stand HZ and the universal stand UG2 as well as subsequent, also continuous, reversing pass sequences R7, R8, R9 in the reverse sequence through the aforementioned stands and in another continuous pass sequence 10, 11, 12 in the initial direction through these stands. In this case, the X-H-rolling procedure is used, i.e., the flanges of the I-section are bent slightly outwardly during the respective pass through the universal stand UG1 by means of the V-shaped vertical rolls VW and are subsequently returned once again into the original H-position through section-rolling of the horizontal stand HZ and the cylindrical vertical rolls ZW of the universal stand UG2.

Figure 4:
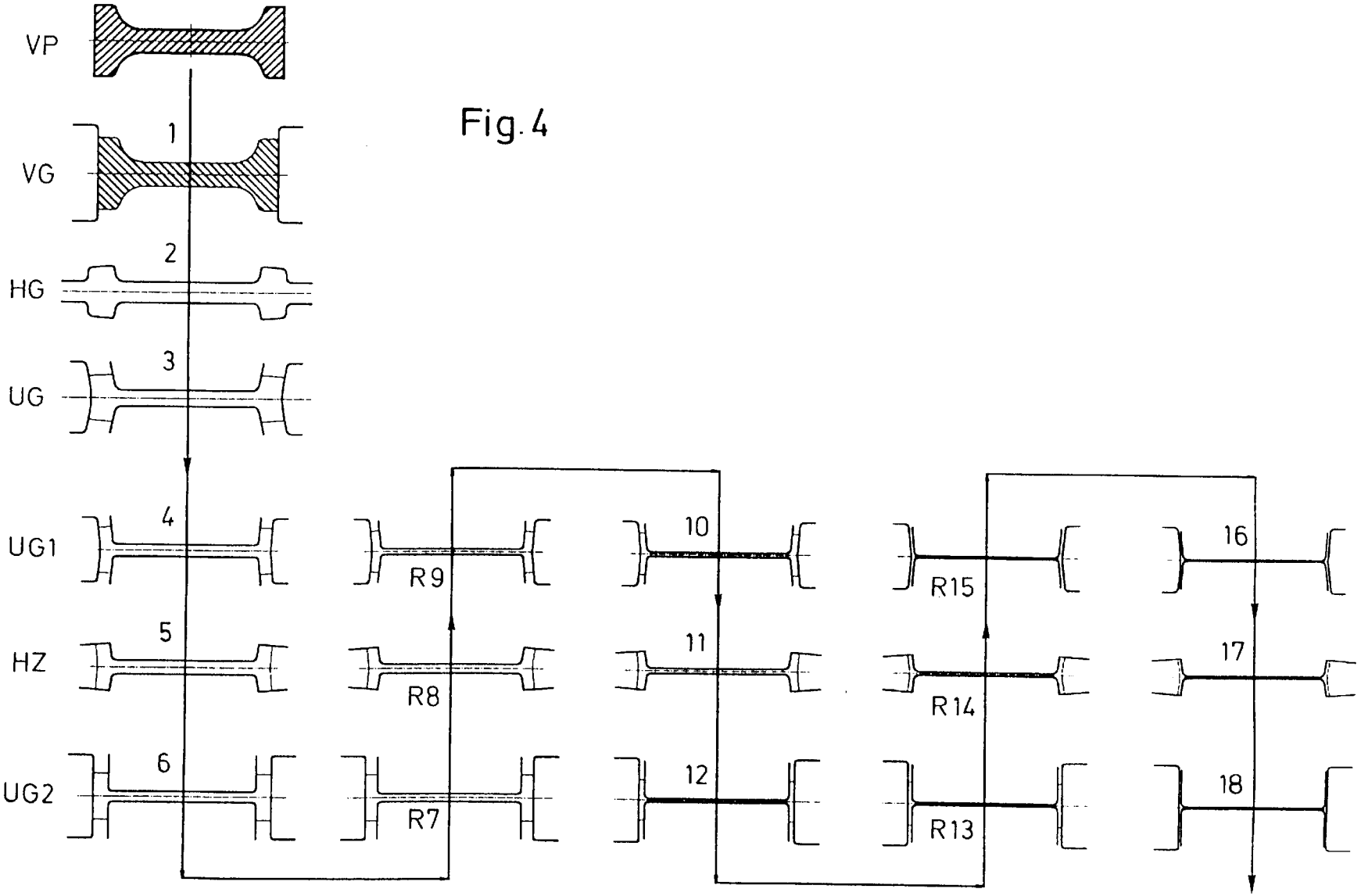

The pass schedule according to FIG. 4 substantially corresponds to that of FIG. 3 with the exception that a preliminary section VP with a I-shaped cross-section with dimensions close to the final dimension is used as the initial section, and that in the tandem compact rolling group altogether five passes are necessary through the universal stand UG1, the horizontal HZ and the universal stand UG2 in pass or reversing pass sequences 4, 5, 6, R7, R8, R9, 10, 11, 12, R13, R14, R15, 16, 17, 18 in order to shape the finished section which has very thin walls.

Figure 5:
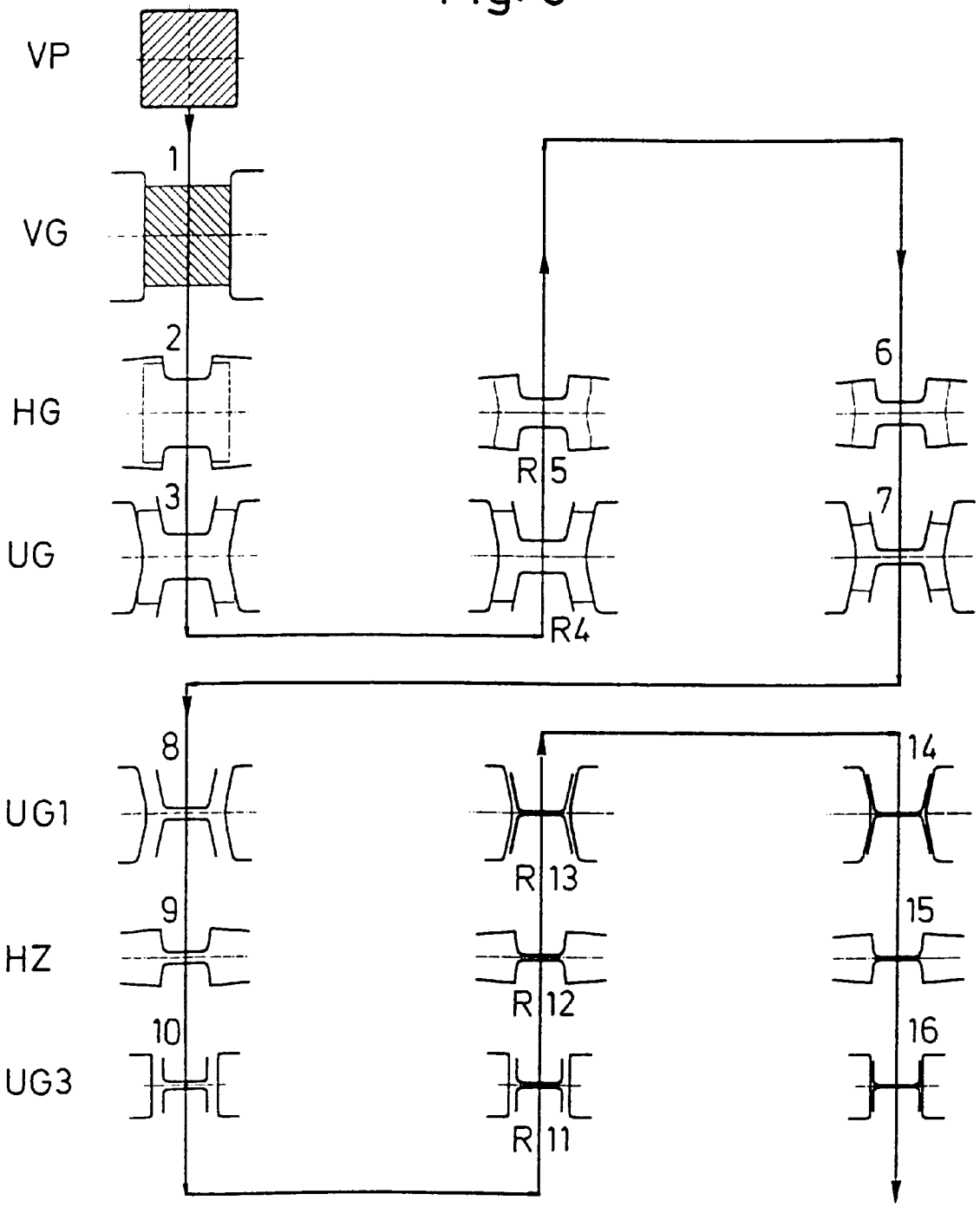

In the pass schedule according to FIG. 5, after the edging pass 1 through the vertical stand VG, the preliminary section VP is shaped into an X-section already in the roughing group in successive passes 2, 3 and in reversing passes R4, R5, and once again passes 6, 7 through the horizontal stand HG and the universal stand UG, and then, in accordance with the illustration with FIG. 3, is finish-shaped in the tandem compact rolling group in three continuous sequences and reversing pass sequences 8, 9, 10, R11, R12, R13, 14, 15, 16.

Figure 6:
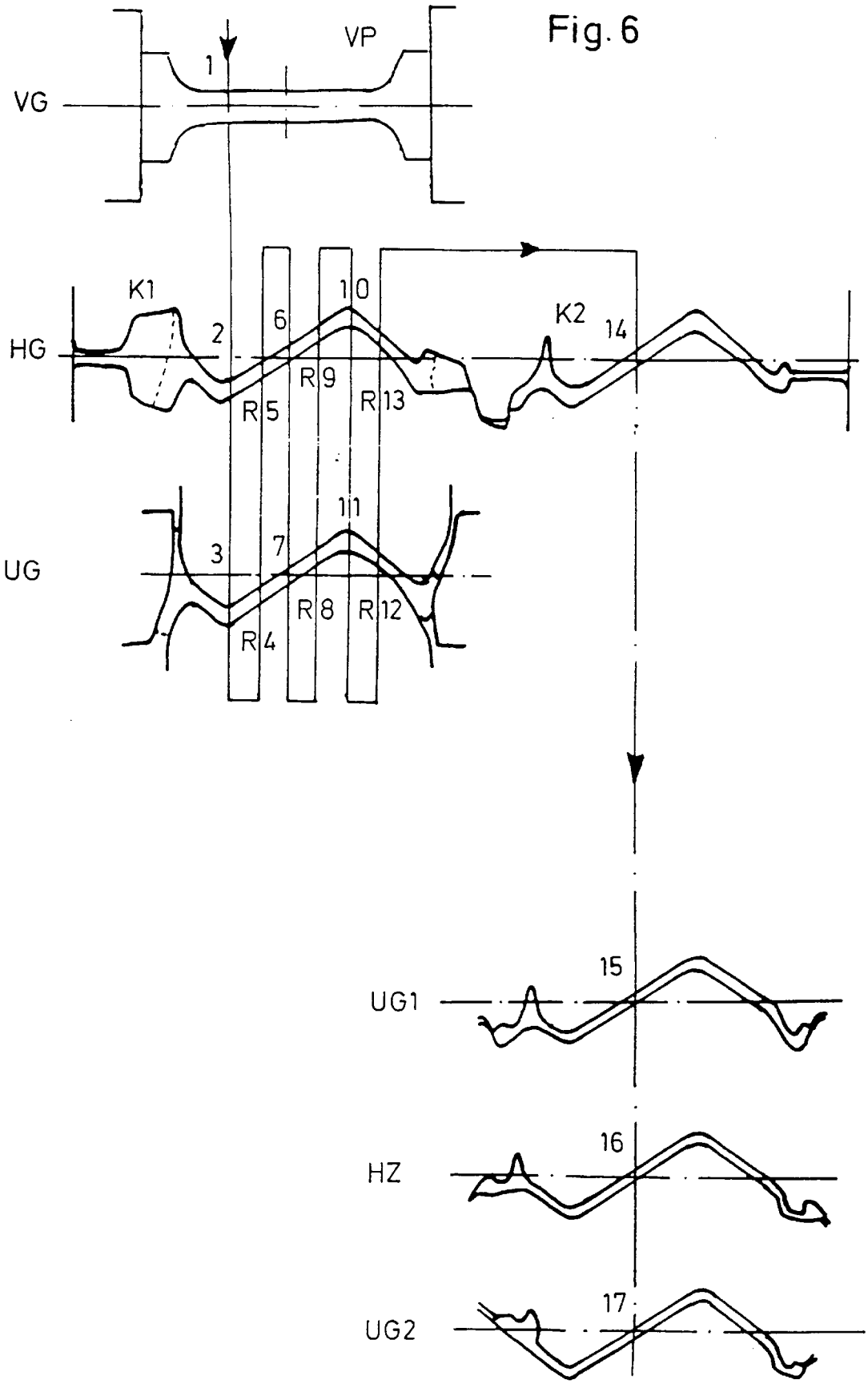

For carrying out the pass schedule according to FIG. 6, the roughing group is equipped with a horizontal stand HG which has sets of grooved rolls with two selectable grooves K1 and K2 and the rolls of the universal stand UG of the roughing group as well as the rolls of the stands of the tandem compact rolling group UG1, HZ and UG3 are equipped with rolls of the type which permit the manufacture of sheet pile sections.

The preliminary section VP, in this case with a I-shaped cross-section, is substantially section-shaped after the edging stand 1 in the vertical stand VG in two successive passes and reversing passes 2, 3, R4, R5, 6, 7, R8, R9, 10, 11, R12, R13 through the first selectable groove K1 of the horizontal stand and the universal stand UG and is then finish-rolled after a single subsequent pass 14 through the second selectable groove K2 of the horizontal stand HG in a single continuous pass sequence 15, 16, 17, through the stands UG1, HZ and UG3 of the compact rolling group.

Figure 7:
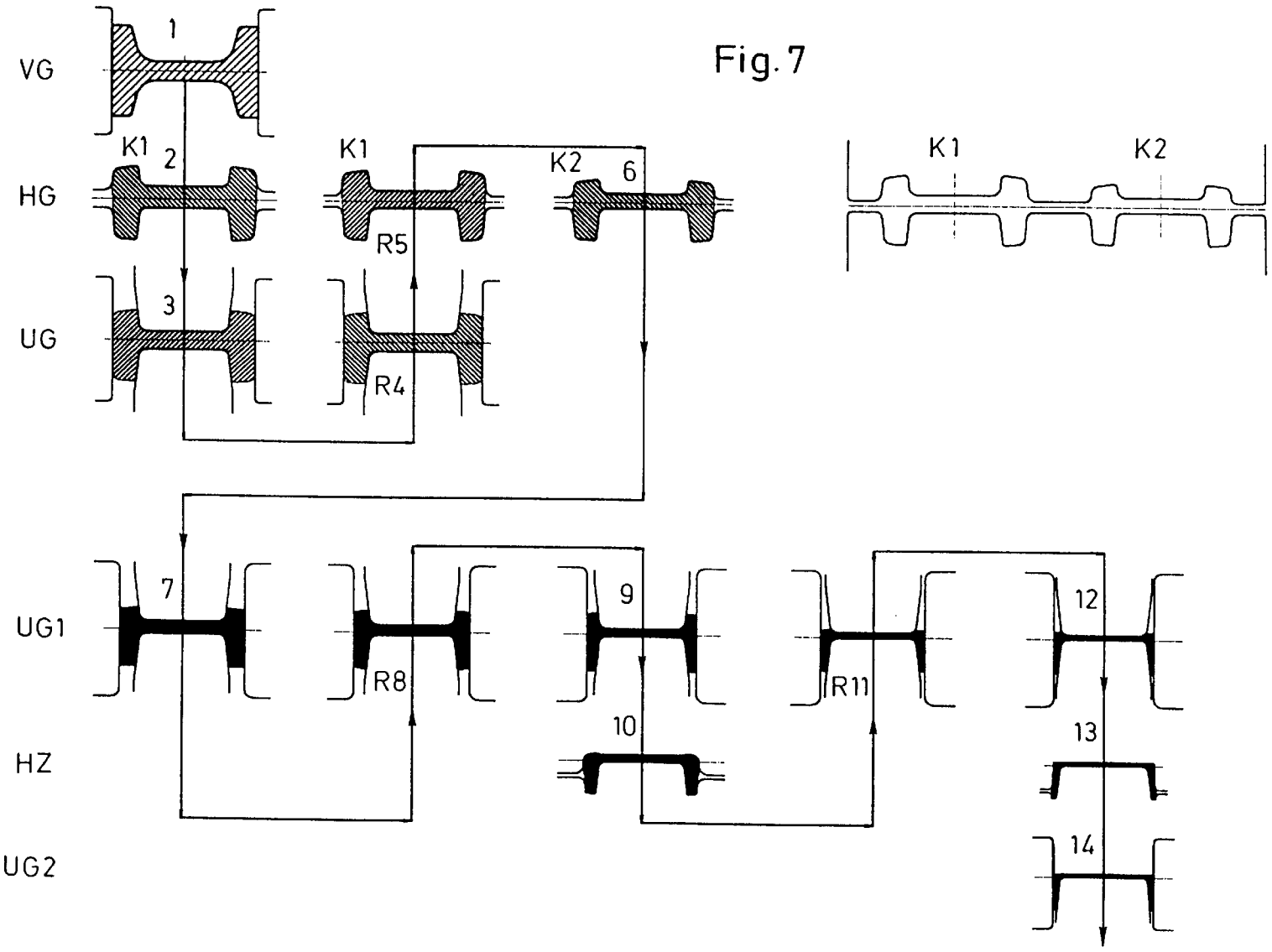

For carrying out the pass schedule according to FIG. 7, the horizontal stand HG of the roughing group is equipped with selectable grooves K1 and K2. The preliminary section is edged in a first pass 1 in the vertical stand VG of this roughing group, is subsequently section-shaped in the selectable groove K1 of the horizontal stand HG and in the universal stand UG in consecutive passes 2 and 3 and in subsequent reversing passes R4 and R5 in stands UG and HG and in the same selectable groove K1 of this stand and subsequently in a subsequent pass 6 through the other selectable groove K2 of the stand and is section-reduced. The section obtained in this manner is further reduced in the universal stand UG1 on the entry side of the compact rolling group in a pass and reversing pass sequence 7, R8, 9 and flange-reduction is effected in a subsequent pass 10 through the edging stand HZ and is then finish-shaped in a subsequent reversing pass R11 and a subsequent pass 12 for the universal stand UG1 on the entry side and consecutive passes 13 and 14 through the edging stand HZ and the universal stand UG2 on the exit side.

Figure 8:
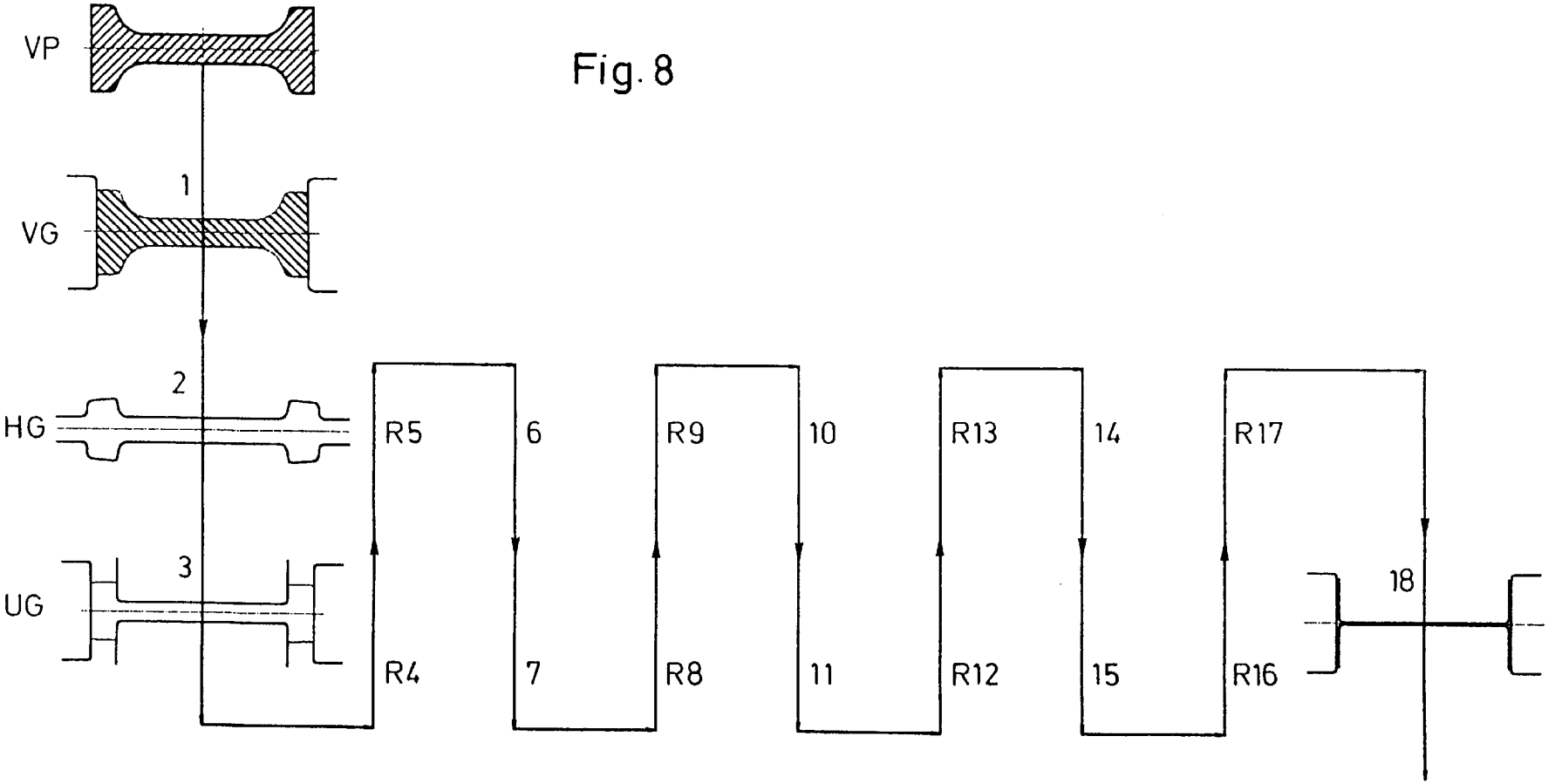

In the pass schedule according to FIG. 8, the heavy preliminary section VP, in this case with a I-shaped cross-section, is edged in a first pass 1 in the vertical stand VG of the roughing group and is subsequently forcibly edged in a pass and reversing pass sequence 2, 3; R4, R5; 6, 7; R8, R9; 10, 11; R12, R13; 14, 15; R16, R17 through the horizontal stand HG and the universal stand UG in the horizontal stand HG and is section-shaped and section-reduced in the universal stand UG and is then finish-rolled in a last pass 18 through the universal stand UG and then, as already explained, is moved onto the roller table R3 by the roller table 1 shown in FIG. 1 extending past the rolling group and the transverse conveying unit QT2 arranged between the roller table R3 following the compact rolling group and the roller table R1.

While specific embodiments of the invention have been shown and described in detail to illustrate the inventive principles, it will be understood that the invention may be embodied otherwise without departing from such principles.

We claim:

1. A rolling plant for rolling all types of finished sections from flat blooms or preliminary sections which have close to finals dimensions and arrive from a continuous casting plant and may be stored or maintained at rolling temperature in reheating furnaces arranged upstream, the rolling plant comprising a compact rolling group with a pair of universal stands arranged closely one behind the other and an edging stand arranged between the universal stands, and a roughing group arranged parallel and offset to the compact rolling group, the roughing group comprising a group of at least one vertical stand, a horizontal stand and a universal stand arranged closely one behind the other, further comprising a first roller table in front of the compact rolling group and a second roller table arranged following the compact rolling group, wherein each roller table has a length corresponding to a length of a finished rolling stock, and a third roller table arranged following the roughing group, wherein the third roller table extends parallel to and over the length of the first and second roller tables and past the compact rolling group, and wherein a first transverse conveying unit is arranged between the third roller table and the first roller table and a second transverse conveying unit is arranged between the third roller table and the second roller table.

2. The rolling plant according to claim 1, wherein the roughing group is comprised of a vertical stand, a horizontal stand and a universal stand.

3. The rolling plant according to claim 1, wherein the horizontal stand of the roughing group has two or more selectable grooves.

4. The rolling plant according to claim 1, wherein the compact rolling group includes a horizontal stand, the horizontal stand of the compact rolling group having two or more selectable grooves.

5. The rolling plant according to claim 1, wherein the universal stand of the roughing group has a roll set with a H-shaped groove configuration with cylindrical vertical rolls.

6. The rolling plant according to claim 1, wherein at least one of a roll set of the universal stand of the roughing group and a roll set of a universal stand of the compact rolling group has a X-shaped groove configuration with V-shaped vertical rolls.

7. The rolling plant according to claim 1, wherein at least one of a roll set of the horizontal stand, the universal stand of the roughing group and the stands of the compact rolling group have rolls with special grooves.

8. The rolling plant according to claim 1, wherein the universal stands of the compact rolling group have two-high roll sets.

9. The rolling plant according to claim 1, wherein the universal stand of the roughing group has horizontal rolls with a diameter of between 1,200 and 1,800 mm.

10. The rolling plant according to claim 1, wherein the universal stands of the compact rolling group have horizontal rolls with a diameter of between 800 to 1,300 mm.

11. A method of operating a rolling plant for rolling all types of finished sections from flat blooms or preliminary sections which have close to finals dimensions and arrive from a continuous casting plant and may be stored or maintained at rolling temperature in reheating furnaces arranged upstream, the rolling plant including a compact rolling group with a pair of universal stands arranged closely one behind the other and an edging stand arranged between the universal stands, and a roughing group arranged parallel and offset to the compact rolling group, the roughing group including a group of at least one vertical stand, a horizontal stand and a universal stand arranged closely one behind the other, further including a first roller table in front of the compact rolling group and a second roller table arranged following the compact rolling group, wherein each roller table has a length corresponding to a length of a finished rolling stock, and a third roller table arranged following the roughing group, wherein the third roller table extends parallel to and over the length of the first and second roller tables and past the compact rolling group, and wherein a first transverse conveying unit is arranged between the third roller table and the first roller table and a second transverse conveying unit is arranged between the third roller table and the second roller table, the method comprising, for rolling heavy finished sections, finish-shaping the sections in the roughing group, conveying the section on the third roller table and from the third roller table to the second roller table by the second transverse conveying unit, and conveying the sections on the second roller table to further processing units.

12. A method of operating a rolling plant for rolling all types of finished sections from flat blooms or preliminary sections which have close to finals dimensions and arrive from a continuous casting plant and may be stored or maintained at rolling temperature in reheating furnaces arranged upstream, the rolling plant including a compact rolling group with a pair of universal stands arranged closely one behind the other and an edging stand arranged between the universal stands, and a roughing group arranged parallel and offset to the compact rolling group, the roughing group including a group of at least one vertical stand, a horizontal stand and a universal stand arranged closely one behind the other, further including a first roller table in front of the compact rolling group and a second roller table arranged following the compact rolling group, wherein each roller table has a length corresponding to a length of a finished rolling stock, and a third roller table arranged following the roughing group, wherein the third roller table extends parallel to and over the length of the first and second roller tables and past the compact rolling group, and wherein a first transverse conveying unit is arranged between the third roller table and the first roller table and a second transverse conveying unit is arranged between the third roller table and the second roller table, the method comprising conveying the sections on the third roller table and from the third roller table to the second roller table by the second transverse conveying unit, and conveying the sections on the second roller table to a universal stand of the compact rolling group on an exit side of the compact rolling group.

13. A method of operating a rolling plant for rolling all types of finished sections from flat blooms or preliminary sections which have close to finals dimensions and arrive from a continuous casting plant and may be stored or maintained at rolling temperature in reheating furnaces arranged upstream, the rolling plant including a compact rolling group with a pair of universal stands arranged closely one behind the other and an edging stand arranged between the universal stands, and a roughing group arranged parallel and offset to the compact rolling group, the roughing group including a group of at least one vertical stand, a horizontal stand and a universal stand arranged closely one behind the other, further including a first roller table in front of the compact rolling group and a second roller table arranged following the compact rolling group, wherein each roller table has a length corresponding to a length of a finished rolling stock, and a third roller table arranged following the roughing group, wherein the third roller table extends parallel to and over the length of the first and second roller tables and past the compact rolling group, and wherein a first transverse conveying unit is arranged between the third roller table and the first roller table and a second transverse conveying unit is arranged between the third roller table and the second roller table, wherein the roughing group includes a vertical stand with smooth rolls, a horizontal stand with profiled rolls and a universal stand, the method comprising edging a preliminary section having a rectangular cross-section or I-shaped cross-section in the vertical stand of the roughing group, preshaping the preliminary section in the horizontal stand of the roughing group, subsequently section-shaping and section-reducing as required the preliminary section in the universal stand of the roughing group, and subsequently finish-shaping the section in the compact rolling group configured as a tandem group in continuous pass and reversing pass sequences as necessary through the universal stand, the horizontal stand and the universal stand of the compact rolling group.

14. The method according to claim 13, the method comprising carrying out a continuous pass sequence through the stands of the roughing group for effecting edging and section-shaping of the preliminary section.

15. The method according to claim 13, comprising section-shaping and section-reducing of the preliminary section in the roughing group in consecutive pass and reversing pass sequences through the horizontal stand and the universal stand of the roughing group.

16. The method according to claim 15, comprising connecting two selectable grooves in the horizontal stand of the roughing group.

17. The method according to claim 15, wherein the stands of the compact rolling group are equipped with pairs of calibrated horizontal rolls, further comprising shaping a special finished section from a preliminary section having a I-shaped cross-section, and finish-shaping the section in the compact rolling group in a continuous pass sequence through the stands of the compact rolling group.

18. The method according to claim 16, further comprising carrying out successive passes and reversing passes in the roughing group, effecting a further section reduction in a first selectable groove in a subsequent consecutive pass and in a second selectable groove of the horizontal stand of the roughing group, effecting a subsequent section reduction in pass and reversing pass sequences in the universal stand on an entry side and in the edging stand of the compact rolling group, and effecting a final edging shaping by the universal stand on the entry side, the edging stand and the universal stand on the exit side of the compact rolling group.

19. The method according to claim 11, further comprising edging a preliminary section having a I-shaped cross-section in the vertical stand of the roughing group, subsequently edging flanges in a pass and reversing pass sequence in the horizontal stand, section-shaping and section-reducing the section in the universal stand, and finish-rolling the section in a last pass through the universal stand.

* * * * *